US005269910A

United States Patent [19]

Matsumura et al.

[11] Patent Number: 5,269,910

[45] Date of Patent: Dec. 14, 1993

[54] METHOD OF COIL LIQUEFACTION BY HYDROGENATION

[75] Inventors: Tetsuo Matsumura; Kaizaburo Saito; Osamu Okuma; Hiroshi Yoshimura; Yasuo Sugino; Shun-ichi Yanai, all of Kobe; Tatsuo Hirano, Hyogo; Kazuhiro Mae; Koji Murakoshi, both of Kobe, all of Japan

[73] Assignees: Kabushiki Kaisha Kobe Seiko Sho, Kobe; Mitsubishi Kasei Corporation, Tokyo; Idemitsu Kosan Company Limited, Tokyo; Cosmo Oil Co., Ltd., Tokyo; Nippon Brown Coal Liquefaction Co., Ltd., Tokyo, all of Japan

[21] Appl. No.: 590,695

[22] Filed: Sep. 28, 1990

Related U.S. Application Data

[63] Continuation of Ser. No. 824,621, Jan. 31, 1986, abandoned.

[30] Foreign Application Priority Data

Feb. 1, 1985 [JP] Japan ..... 60-19040
Feb. 1, 1985 [JP] Japan ..... 60-19041

[51] Int. Cl.[5] ..... C10G 1/00; C10G 1/06

[52] U.S. Cl. ..... 208/413; 208/412; 208/418; 208/424; 208/433; 208/428; 208/432

[58] Field of Search ..... 208/159, DIG. 1, 412, 208/413, 418, 422, 433, 432, 428

[56] References Cited

U.S. PATENT DOCUMENTS

| | | | |
|---|---|---|---|
| 2,572,001 | 10/1951 | Sellers | 208/418 X |
| 2,913,388 | 11/1954 | Howell et al. | 208/8 |
| 3,117,072 | 1/1964 | DuBois Eastman et al. | 208/418 X |
| 3,679,573 | 7/1972 | Johnson | 208/418 |
| 4,384,948 | 5/1983 | Barger | 208/159 X |
| 4,400,201 | 8/1983 | Givens et al. | 208/412 X |
| 4,421,630 | 12/1983 | Roberts et al. | 208/418 |
| 4,479,184 | 10/1984 | Carson | 208/DIG. 1 |

FOREIGN PATENT DOCUMENTS

| | | |
|---|---|---|
| 0085217 | 8/1983 | European Pat. Off. . |
| 2723018 | 3/1978 | Fed. Rep. of Germany . |
| 3220927 | 4/1983 | Fed. Rep. of Germany . |
| 0173089 | 9/1985 | Japan . |

OTHER PUBLICATIONS

Patents Abstracts of Japan, C-157 Mar. 18, 1983, vol. 7, No. 66.

*Primary Examiner*—Helane Myers
*Attorney, Agent, or Firm*—Oblon, Spivak, McClelland, Maier & Neustadt

[57] ABSTRACT

A method for hydro-liquefying coal, the method comprising preheating a slurried mixture of a pulverized coal and a solvent, the preheated mixture being supplied to a plurality of reactors; separating a gaseous content from the products resulting from the reaction; dehydrating the gaseous content and removing a light oil content therefrom, thereby obtaining hydrogen-content gases; and recycling the hydrogen-content gases at least to the first reactor and supplying it to the bottom thereof so that the light oil content in the solvent is stripped.

7 Claims, 6 Drawing Sheets

I
II
EXHAUST GAS
LIGHT OIL
MEDIUM OIL
COLLECTED SOLVENT
SLUDGE
SOLVENT
PULVERIZED COAL
SLURRYING SOLVENT
H2
P
1
2a
2b
2c
3
4
5
6
7
8
9a
9b
9c
10
11
12
14

METHOD OF COIL LIQUEFACTION BY HYDROGENATION

This is a continuation of application Ser. No. 824,621, filed Jan. 31, 1986 now abandoned.

FIELD OF THE INVENTION

The present invention relates to a method for hydro-liquefying coal, and more particularly, a method for slurrying powdery coal with the addition of a solvent thereby to hydro-crack the coal into a liquid state.

DESCRIPTION OF THE PRIOR ART

To liquefy a solid coal a hydro-cracking method is known in the art. Under this method coal is pulverized, and admixed with a slurrying solvent. Then the mixture is supplied to a hydro-reactor in which it is hydro-cracked at an elevated temperature in the presence of pressurized hydrogen.

In order to explain the background in more detail, reference will be made to FIG. 1:

In this specification the term heavy means that a substance has higher molecular weight, and the term light means that a substance has lower molecular weight. The term medium means that a substance has moderate molecular weight.

There are two sections (I) and (II) in FIG. 1; the former is a primary hydro-cracking equipment, and the latter is a secondary hydro-cracking equipment. Pulverized coal is admixed with a solvent, and the mixture is sent to a preheater 1 by means of a pump (P). After it is heated to a desired temperature it is sent to the primary section (I). To convert the pulverized coal into the state of slurry a suitable solvent, and a catalyst such as iron-sulfur catalyst, is added, and the pressurized hydrogen is supplied into a pipe through which the slurry is conducted, at a point located immediately before the slurry enters the preheater. The preheated slurry and hydrogen pass through a first reactor 2*a*, a second reactor 2*b* and a third reactor 2*c* in the three physical phases, that is, gaseous, liquid and solid phases. In the course of passing through these reactors the slurry is subjected to hydro-cracking.

Finally the slurry is sent to a separator 3 in which the gaseous content is separated from the liquid content. The liquid content contains ash (containing inorganic matter present in the coal, and the catalyst), and is sent to a distilling tower 4. The gaseous content contains a light oil content, water, and unreacted hydrogen, and is sent to a condenser 5 in which the water and the light oil are condensed. Then the condensed water and oil are separated from each other by means of a separator 6. In this way the light oil is collected, and the gaseous content is discharged out of the system. The discharged gases contain a large quantity of hydrogen remaining unused which can be utilized for hydro-cracking after CO, $CO_2$ and hydrocarbons are wholly or partly removed. In the reactors 2*a* to 2*c* the temperatures are likely to become high; sometimes too high depending upon the concentration of the slurry and the kind of coal. It is therefore necessary to cool the reactors, and to this end part of the exhaust gas is supplied through the side walls as a coolant.

The liquid content sent to the distilling tower 4 is separated into a light oil, a medium oil, a recovered solvent and a heavy oil containing ashes (sludge), which is subjected to the removal of ashes by means of a separator 7. When necessary, the sludge is subjected to the removal of bitumen content, and sent to the secondary hydro-cracking section (II) in which the heavy oil content free from ashes and bitumen is admixed with a solvent (and a catalyst for the secondary hydro-cracking). The mixture is heated to a desired temperature in the presence of hydrogen, and passes through reactors 9*a*, 9*b* and 9*c*. The products from the last reactor 9*c* are separated into a gaseous content and a liquid content by means of a condenser 10, of which the liquid content is sent to a distilling tower 11 in which a light oil, a medium oil, a recovered solvent and a sludge are separated. The waste solvent collected in the distilling towers 4 and 11 is recycled as slurrying solvent. The gaseous content collected in the condenser 10 is re-used as hydro-cracking hydrogen after CO, $CO_2$ and hydrocarbons are removed.

Through the series of steps including the primary and secondary sections coal is cracked, thereby producing light and medium oils of commercial value. The number of the reactors is not limited to three but can be more than that. They can be arranged in series. It is possible to dispense with the secondary section (II) when the capacity of the primary section (I) is sufficiently large. Part of the heavy oil exhausted from the distilling towers 4 and 11 can be admixed with the mixed slurry for the primary hydro-cracking, so as to hydro-crack the contents having higher molecular weight which remain uncracked.

Under the known systems mentioned above the operation takes place under moderate pressures and temperatures, and with minimum consumption of hydrogen. This results in a high yield of heavy oil content (SRC) and a low yield of light oil content. Consequently, in order to increase the yield of a light oil content the pressures and temperatures must be stepped up, and the amount of catalyst is increased. However these intensified reactive conditions are likely to cause such a rise in temperature that the thermal control becomes difficult. This is an obstacle to the stable and safe operation. In addition the cracking of a light oil content remarkably advances, thereby increasing the amount of low carbon gases. After all the total yields of heavy and light oils are not so increased as to be expected.

In the hydro-liquefying reaction it is known in the art that the oil collection varies with the types of slurrying solvent, and that a heavier solvent (of three to four or more links) exhibits a better performance. Therefore a heavier one is preferably used as a solvent. On the other hand the heavy solvent is rather viscous, and when it is admixed with a pulverized coal the slurried mixture becomes viscous, and is lacking in fluidity. This causes difficulty in preparing and transporting the slurry. To reduce this difficulty a considerable amount of light oil is added to control the viscosity of the resulting slurry. However the addition of light oil is likely to reduce the efficiency of hydro-cracking, which leads to the reduced oil collection. The dilution of heavy oil also reduces the reaction efficiency. Furthermore in each reactor the concentration of heavy oil is further reduced. In this way all these negative factors unfavorably affect the efficiency of hydro-crackings. Basically an adequate amount of solvent is required to dissolve the powdery coal sufficiently at the stage of preheating, and restrain a high condensation, but since at the stage of hydro-cracking the solvent is considerably diluted, it is desirable to provide a small supply of solvent beforehand.

As evident from the foregoing description, the solvent demands are opposite between the preheating stage and the hydro-reacting stage. Under the conventional practice an optimum amount of solvent is determined for each. However it is unavoidable that the solvent is considerably diluted in comparison with the concentration required for the hydro-reaction. As described above one alternative is to add an uncracked heavy oil content from the hydro-reacting equipment to the slurry, so as to repeat the hydro-cracking so that the yields of light and medium oil contents may be increased. However, for the above-mentioned reason it is difficult to recycle a great amount of heavy oil. Hence the resulting effects are as great as expected.

As will be understood from the foregoing description, the conventional method for hydro-liquefying coal has the disadvantage of low yields of oils because of the difficulty in obtaining a heavy slurry solvent at the hydro-cracking stage.

OBJECTS AND SUMMARY OF THE INVENTION

The present invention aims at overcoming the problems pointed out with respect to the known methods for hydro-liquefying coal, and has for its object to provide a method for hydro-liquefying coal with high yields by effecting a high concentration of slurry and increasing the average molecular weight of the solvent.

Another object of the present invention is to provide a method for hydro-liquefying coal which enables the hydrogen gas generated by the reaction to be recycled for subsequent use.

A further object of the present invention is to provide a method for hydro-liquefying coal wherein part of the heavy oil content produced from the hydro-reaction is extracted and added to the original slurry so as to increase the average molecular weight of the solvent in the slurried mixture which is supplied to the hydro-reactor, thereby increasing the efficiency of the hydro-reaction.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to the present invention there is a method for hydro-liquefying coal, the method comprising:

preheating a slurried mixture of a pulverized coal and a solvent, the preheated mixture being supplied to a plurality of reactors;

separating off a gaseous content from the products resulting from the reaction;

dehydrating the gaseous content and removing a light oil content therefrom, thereby obtaining hydrogen-content gases; and recycling the hydrogen-content gases at least to the first reactor and supplying it to the bottom thereof so that the light oil content in the solvent is removed.

DETAILED DESCRIPTION OF THE INVENTION

Figure 1:
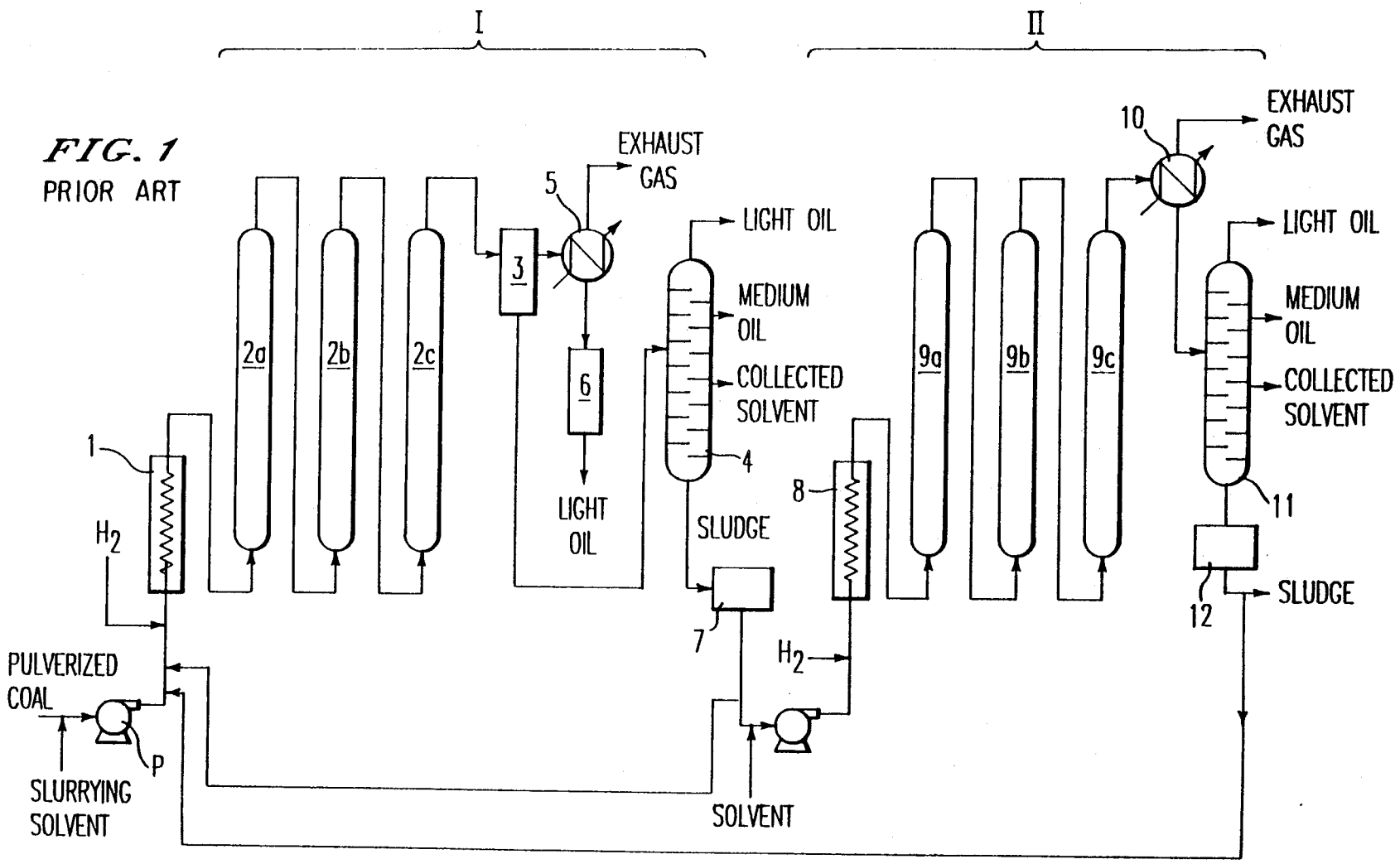
FIG. 1 PRIOR ART
FIG. 1 illustrates conventional prior art hydro-cracking equipment.
Figure 2:
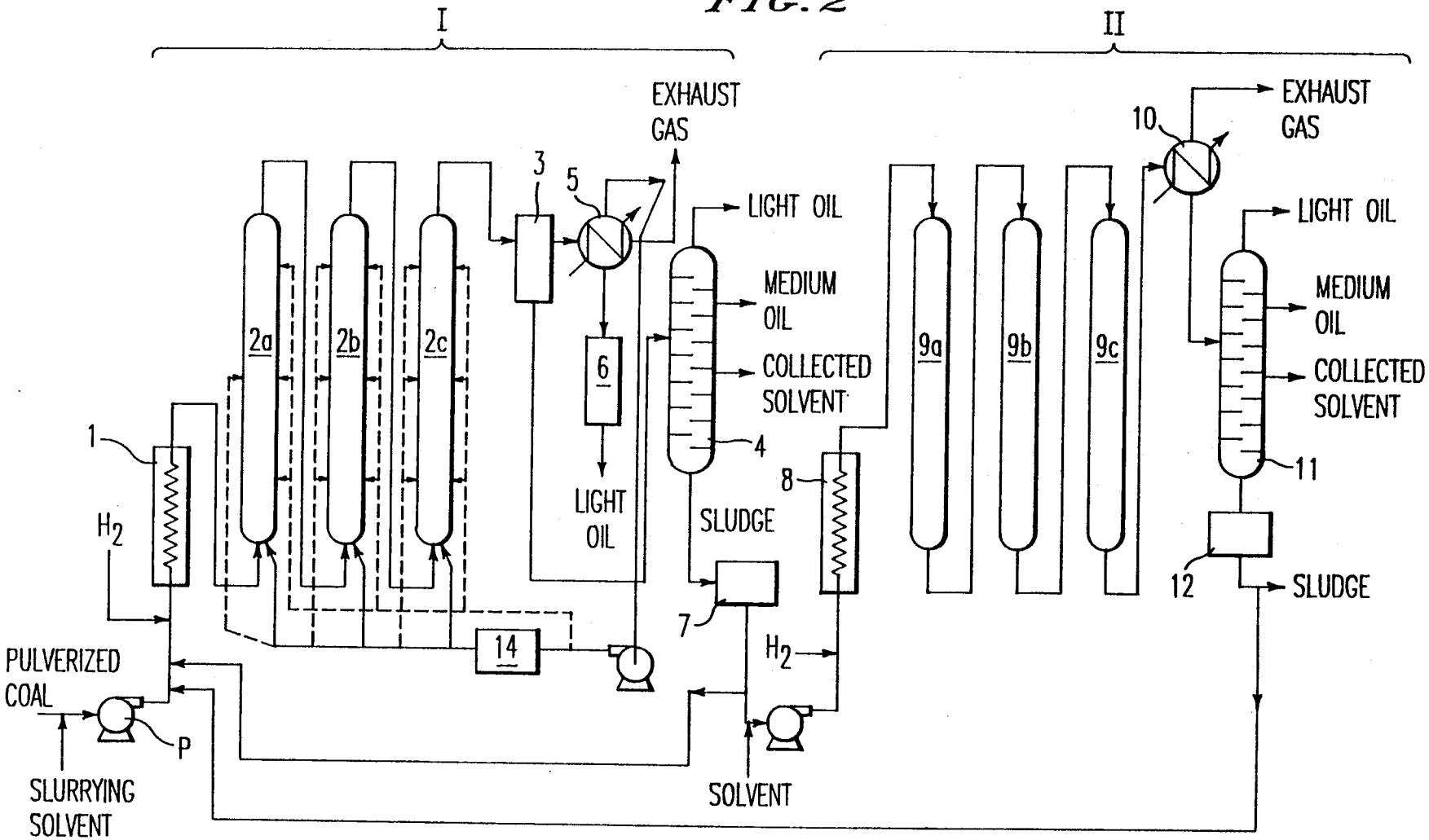
FIG. 2 illustrates the equipment of the present invention and shows how the equipment of the invention is different from prior art equipment.
Figure 3A:
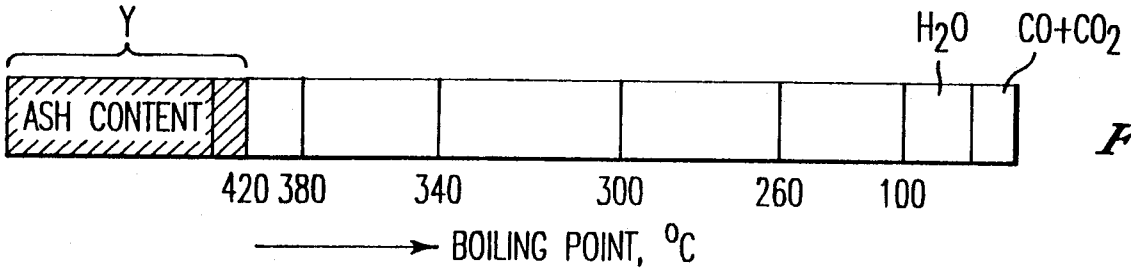
FIGS. 3 and 4 show data on slurry compositions after light and heavy hydro-cracking conditions, respectively.
Figure 3B:
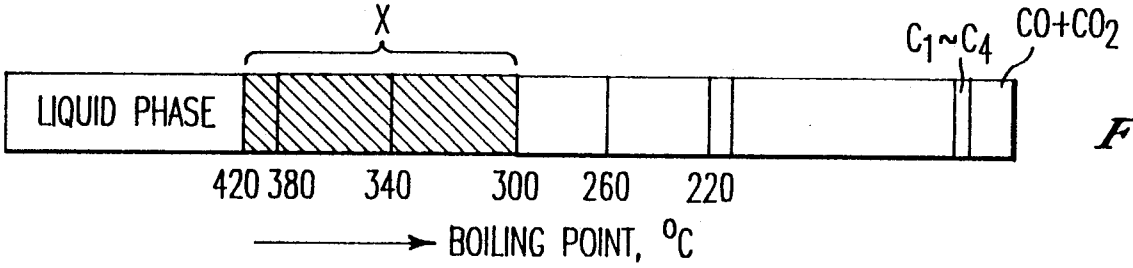

Referring to FIG. 2 the illustrated equipment is basically the same as that shown in FIG. 1. However the equipment of the invention is different from that of FIG. 1, in that part of the heavy oil content from the distilling towers 4 and 11 of the primary and secondary equipments is recycled to the primary equipment for hydro-cracking, wherein the heavy oil content can be either before or after the ash content is removed. Normally the latter is applied. It also differs in that the gases containing hydrogen which are separated by the condenser 5 of the primary equipment (I), hereinafter referred to as the recycle gas, are extracted by a pump 13, and heated to a desired temperature by means of a heater 14. The heated gas is then blown into the bottom of each reactor 2*a*, 2*b* and 2*c*. The feature of the present invention mainly resides in these unique systems.

More specifically, when each reactor receives the recycle gas through its bottom the contents having low boiling points rapidly rise up the reactor, thereby accelerating the increase in average molecular weight of the solvent. As a result the efficiency of hydro-reaction in the reactors is enhanced, thereby increasing the rate of the oil collection. Under the present invention the light oil content is exhausted out of the equipment together with the gases, whereas under the known system the light oil content is subjected to hydro-reaction. Under the invention, therefore, the rate of light oil collection is remarkably increased. In addition, the accelerated increase in average molecular weight of solvent in the reactors allows a considerable amount of light solvent to be added at the stage of preparing the slurry. This is conducive to the efficient preparation of slurry and easy transport of products through pipes. Furthermore, the pulverized coal can be heated by means of the preheater 1 in a short time. In the illustrated series of equipment (I) and (II) part of the heavy oil content exhausted therefrom is admixed with the original slurry for a second hydro-cracking, wherein the heavy oil has not fully been cracked in the first hydro-cracking. However, under the present invention such heavy oil content is no problem at all because of its high hydro-cracking performance assisted by the increased molecular weight of the solvent. This has made it possible to recycle the heavy oil of little commercial value for the conversion of light and medium oils. The medium oil is highly viscous, so that choking troubles are likely to occur in the preheater 1 or other process lines. Under the present invention a sufficient amount of light solvent is added to the slurrying solvent at the state of preparing the slurry so as to make the slurring solvent sufficiently fluid, thereby avoiding the choking troubles.

In order to effect the stripping by recycling the hydrogen-content gases as efficiently as possible, many experiments have been conducted so as to find the optimum conditions. As a result the following facts have been found:

(A) The residue in the solvent present in the reactor which has a boiling point of 300° to 420° C. (at normal pressure); and (B) The total amount (Y) of the coal present in the mixed slurry supplied to the reactors, and a residue having a boiling point of not smaller than 420° C. (at normal pressure), wherein the coal is presupposed to have no water nor ashes, should be maintained within relative limits to maximize performance.

The repeated experiments have revealed that the ratio X/Y by weight is a very important factor which affects the effects of the stripping and the conditions in the reactors. Furthermore, an optimum range of this ratio has been found, that is, the range of 0.20 to 1.20 preferably 0.30 to 0.80. When the value X/Y is within this range, the effects of blowing the recycle gas into the reactor are maximized. The reason why this numerial range is set will be explained below:

When the reactor receives a supply of recycle gas through its bottom, the content having a lower boiling point in a liquid state is rapidly discharged out of the reactor, thereby accelerating the increase in average molecular weight of the solvent. The degree of the increase in average molecular weight depends on the temperature and pressure at which the hydro-reaction is carried out. Therefore it is difficult to control the degree of molecular weight increase of the solvent merely by adjusting the temperature and amount of the recycle gas. In order to overcome this difficulty the optimum range of the average molecular weight of the solvent has been ascertained under the present invention, with a view to increasing the rate of oil collection. As a result it has been found out that many factors are present and must be taken into consideration, which are shown in FIGS. 3 and 4. The data shown therein were obtained by selecting two modes of treatment, one being light and the other being heavy, wherein the light treatment means an experiment on which the already recognized effects of blowing the recycle gas was ascertained, and the heavy treatment means an experiment which showed a critical limit beyond which a choking trouble is likely to occur if the blowing of recycle gas continues with a supply of the heavy oil content present in the hydro-products as a slurrying solvent.

Figure 4A:
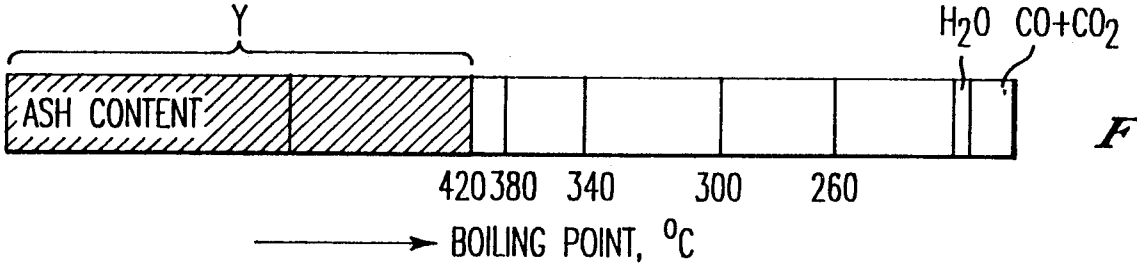
Figure 4B:
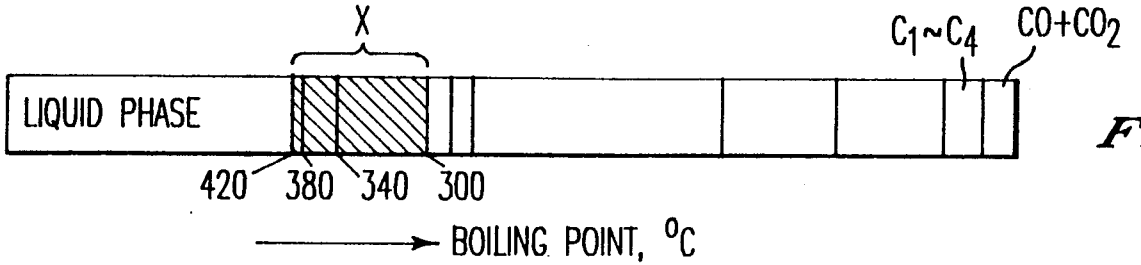

On the basis of the data the degree of average molecular weight increase resulting from the light treatment and the heavy treatment is compared in terms of a ratio of the amount (X) of light and medium oils obtained from the experiment (A) in which their boiling points fall in the thermal range of 300° to 420° C., and the total amount (Y) of the coal content in the original slurry and the heavy oil having a boiling point of not lower than 420° C. In the light treatment the following equation is established as evident from FIG. 3(A) and (B):

$$X/Y=37/33=1.12$$

whereas in the heavy treatment the following equation is established as evident from FIG. 4(A) and (B):

$$X/Y=19/64=0.30$$

It will be understood from these values that the optimum ratio of X/Y is 1.12 for achieving the object of increasing the average molecular weight of the solvent. It is possible, however, to increase this value up to 1.20 depending on the kind of a slurring solvent to be used and/or the conditions for hydro-cracking. The upper limit for increasing the average molecular weight of the solvent, that is, the critical point at which a choking is likely to occur because of an excess of the heavier fraction is anticipated by reference to the X/Y value obtained from the heavy treatment, as shown in FIG. 4(A) and (B). If the conditions for hydro-cracking is optimized, the upper limit can be reduced up to: (X/Y=0.20) or so. From these results the following relationship is obtained:

$$0.20 \leqq (X/Y) \leqq 1.12$$

Furthermore, after more experiments have been conducted so as to obtain an optimum range in which the effects of the increase of the average molecular weight is secured, a range of 0.30 to 0.80 has been ascertained.

FIG. 2 shows an example in which the recycle gas is blown into all the reactors 2*a*, 2*b* and 2*c*, but it is possible to supply it to the first reactor 2*a* alone which holds more content remaining uncracked than any other reactor, or to the first reactor 2*a* and the second reactor 2*b*. Alternatively it is possible to blow a hydrogen-content gas separated by means of the condenser 11 into the reactors 9*a* to 9*c* in the secondary equipment (II).

The hydro-reaction evolves heat, thereby causing the internal temperatures in each reactors to rise excessively, particularly when a heated recycle gas is introduced in through the bottoms thereof. In such cases it is necessary to lower the temperature of the recycle gas, and also to send a supply of recycle gas not yet preheated as a coolant, which is preferably blown into the reactors from the side walls thereof. On the other hand, when the internal temperature falls excessively, a heated recycle gas can be supplied through the side walls of the reactors, thereby keeping the internal temperature moderate as desired. In FIG. 2 the hydrogen-content gas from the primary equipment (I) is blown into the reactors 2*a* and 2*b* therein, but it is possible to supply a hydrogen-content gas from the secondary equipment (II) to those of the primary equipment (I).

In the illustrated embodiment each equipment (I) and (II) is provided with three reactors arranged in series, but the number thereof is not limited to three. The secondary equipment can be dispensed with if the primary equipment has a sufficient capacity. In the present invention the recycling of part of the heavy oil content in the hydro-cracking products as a slurrying solvent is not essential, and it can be omitted.

Figure 5:
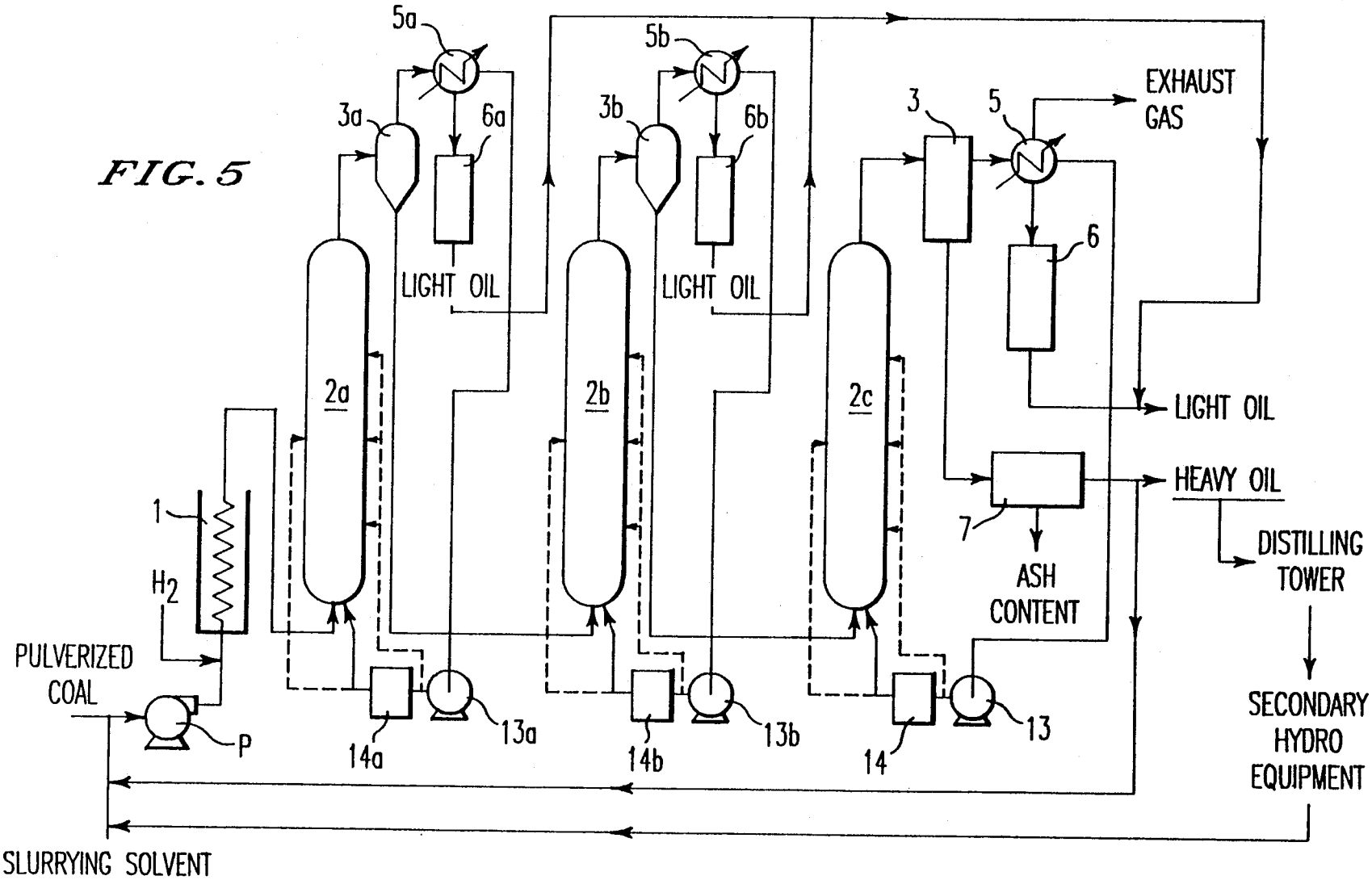
FIG. 5 shows a modified version of the equipment of the present invention.

Referring to FIG. 5 a modified version of the embodiment will be described:

In FIG. 5 the primary equipment alone is illustrated. Each of the reactors 2*a*, 2*b* is respectively provided with a first separator 3*a*, 3*b*, a condenser 5*a*, 5*b*, and a second separator 6*a*, 6*b* in its reactive products exhaust line. The first separator 3*a*, 3*b* is to separate the gas content from the liquid content, and the second separator is to separate the oil content from the water. Under this arrangement the hydrogen-content gas separated by the condensers 5*a*, 5*b* is extracted by the pumps 13*a*, 13*b*, and heated by the heaters 14*a*, 14*b*. In this way the gas is blown into the bottom of each reactor 2*a*, 2*b* as a stripping gas. A hydrogen-content gas from the reactor 2*c* is separated by the condenser 5 via the first separator 3, and blown in the reactor 2*c* by means of the pumps 13, 14. The liquid residue separated from the hydrogen-content gas by the first separators 3*a*, 3*b* and 3 is gradually fed downstream. The light oil content condensed by each condenser 5a, 5b and 5 and separated by each second separator 6a, 6b and 6 is extracted as a product. The separation of oil and water can be carried out by the separator 6 alone. The liquid content separated by the first separator 3 is sent to the secondary equipment (II) after the ash content is removed by means of the ash separator 7. In this example it is possible to recycle a heavy oil content whose ash content is removed or the one extracted from the secondary equipment (II) as a slurrying solvent. Under this example the light oil content is exhausted together with gases from the reactors, thereby enabling it to be individually collected therefrom. This is conducive to the prevention of decomposition of the light oil content, thereby leading to the increased rate of oil collection.

Figure 6:
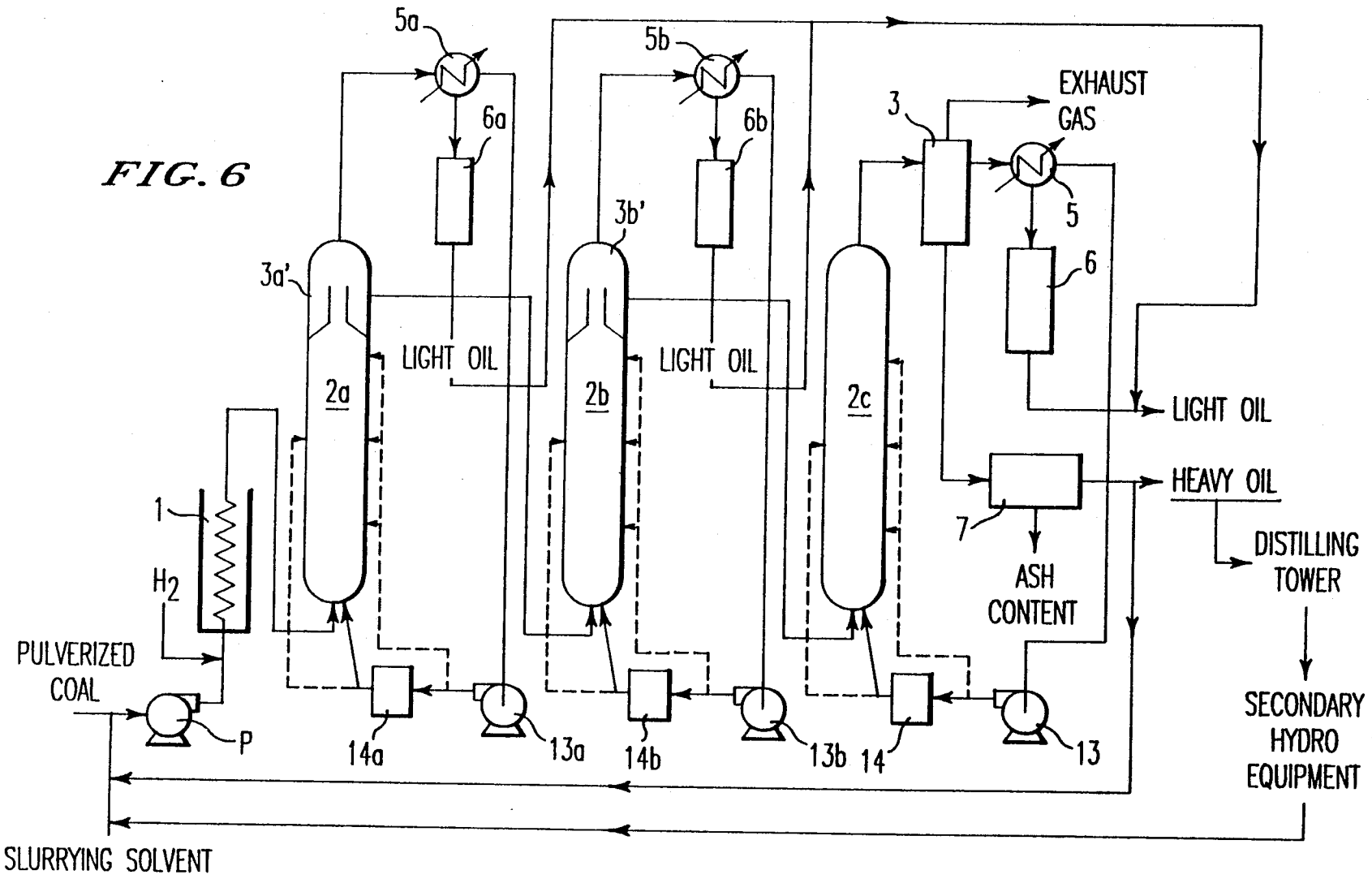
FIG. 6 shows a further embodiment of the equipment of the present invention.

FIG. 6 shows a further example of the embodiment, characterized in that there are first separators 3'a and 3'b (gas/fluid separators) produced in one body with the top portions of the reactors 2a and 2b in the primary equipment and the secondary equipment, respectively. The equipment is operated in the same manner as the second example of FIG. 5.

In the examples of FIGS. 5 and 6 it is possible to recycle part of the heavy oil content extracted from the primary equipment and/or the secondary equipment to admix with the original slurry in the primary equipment. The time for admixture is not limited to after the preparation of slurry but can be before it. It is also possible to send the recycle gas, heated or unheated, to each reactor as a coolant. While the recycle gas keeps warm after heating, it can be used for keeping the internal temperatures in the reactors moderate.

Typical examples of the optimum conditions for carrying out the hydro-reaction under the present invention will be shown:

The primary hydro-reaction:

Temperature: 400° to 470° C. (preferably, 430° to 450° C.)

Pressure: 50 to 300 kg/cm$^2$G (preferable 150 to 200 Kg/cm$^2$G)

Catalyst: iron-sulfur catalyst

Solvent/coal by weight: (maf: no water/no ash basis)=1.7 to 3.0 (preferably 2.0 to 2.5)

Heavy solvent: Hydrocarbons having a boiling point of not lower than 180° C.

Amount of recycle heavy oil: 50% or less by weight present in the solvent as asphalten or preasphalten (preferably 10 to 40% by weight) 120% by weight or less on no water/no ash coal basis (preferably 25 to 75% by weight)

The secondary hydro-reaction:

Temperature: 300° to 450° C. (preferably 360° to 430° C.)

Pressure: 50 to 300 kg/cm$^2$G (preferably 100 to 200 kg/cm$^2$G)

Catalyst: Ni-Mo catalyst

Solvent/SRC by weight (waf)=0.5/1 to 4/1 (preferably 1/1 to 2/1)

The temperatures and amount of the recycle gas may be adjusted in accordance with the types of the coal and slurring solvent, the concentration of the solvent and the conditions for the hydro-reaction. One of the standard conditions for the primary hydro-reaction is the total amount of the recycle gas is not greater than 80 m$^3$ for a ton of solvent in the slurry (preferably 8 to 50 m$^3$). If the temperature of the recycle gas is too high or the amount is too much, the solvent in the reactor is likely to gasify rapidly, thereby causing a choking trouble. On the other hand, when the temperature is too low or the amount is insufficient, the effect described above do not result. The temperature of the recycle gas is controlled by regulating the heaters 14, 14a and 14b. The amount thereof is controlled by regulating the sucking force of the pumps 13, 13a and 13b. When the recycle gas is blown into the reactors, it is preferred to supply the greatest amount of it to the first reactor 2a, a lesser amount to the second reactor and a far less amount to the third reactor. In this way a diminishing amount of gas is supplied to the reactors.

Let take an example for an equipment having three reactors in series, to show an example of the optimum rates of recycle gas:

| | The amounts of the recycle gas (volumetric ratio) | | |
|---|---|---|---|
| | 1st Reactor | 2nd Reactor | 3rd Reactor |
| Optimum ratio | 1.0 | 0.2~0.6 | 0.1~0.6 |
| Example 1 | 9 | 3 | 2 |
| Example 2 | 4 | 2 | 1 |
| Example 3 | 3 | 1 | 1 |

EXAMPLE

The equipment: a type having three reactors in series (as shown in FIG 5)

Temperature: 430° C.

Pressure: 150 kg/cm$^2$G

Solvent/coal by weight: 2.5 (maf no water/no ash coal basis)

Catalyst: Iron-sulfur catalyst

Amount of hydrogen: 10% by weight (maf)C

Recycle gas to reactor: 26 m$^3$ for a ton of solvent at 430° C. (ratios: nine parts for the 1st reactor, three parts for 2nd reactor and two parts for the third reactors)

Composition: $H_2$: 84.2% $CO+CO_2$: 8.9% $CH_4$: 4.3% others: 2.6%

Figure 7:
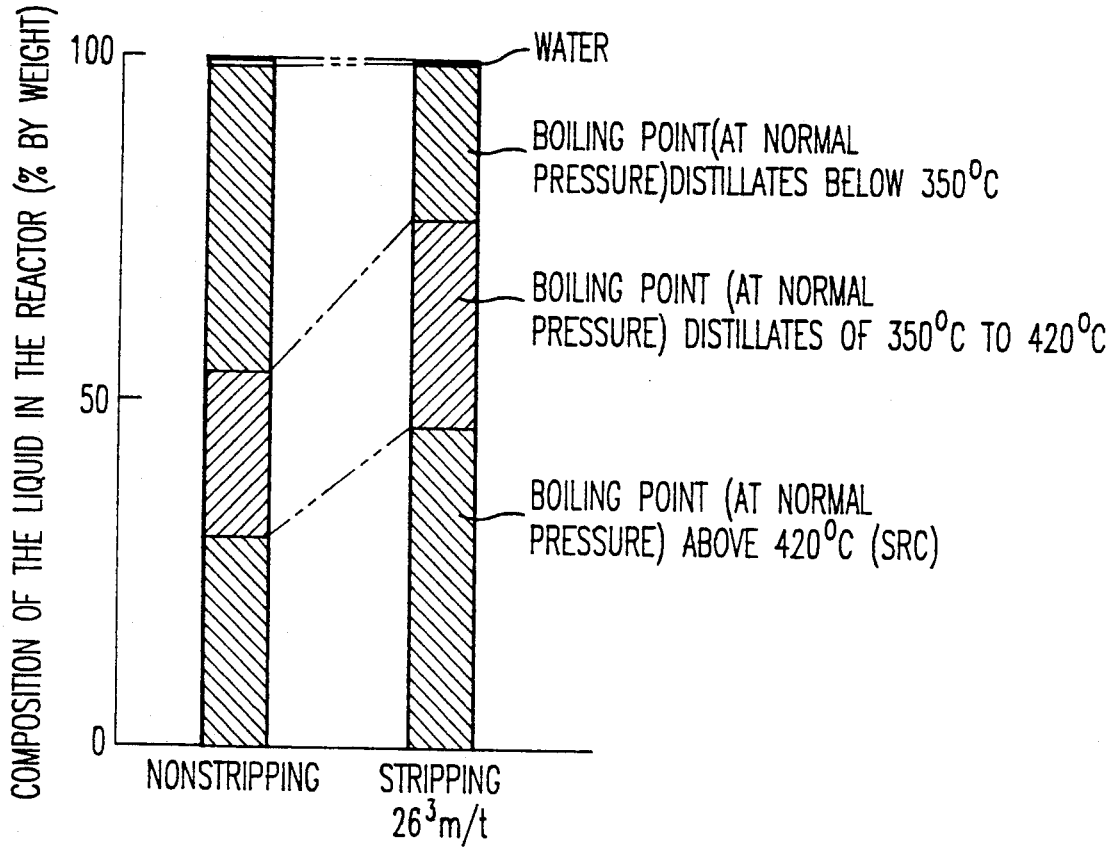
FIG. 7 illustrates the difference in products obtained by the present process and a comparative process in which no recycled gas is used to strip the light oil fraction.
Figure 3A:
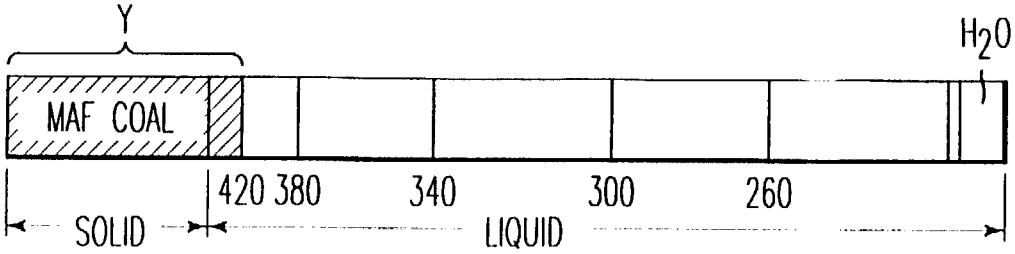
Figure 3B:
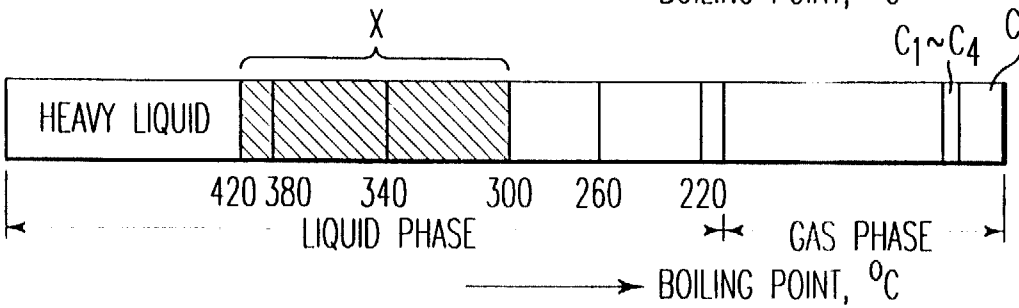
Figure 4A:
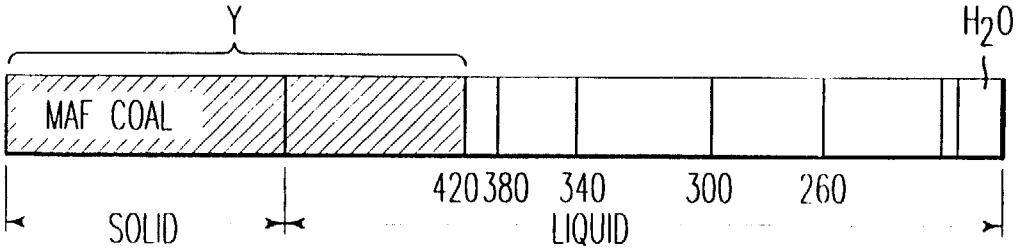
Figure 4B:
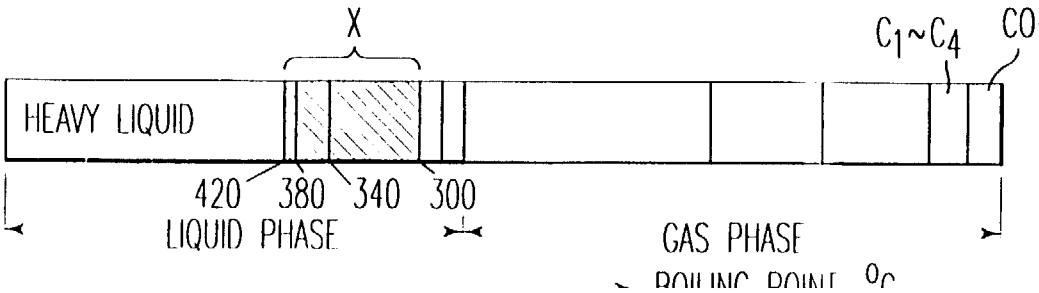

Under the above-mentioned conditions the experiment was conducted, and the yields of the resulting products have been compared with those obtained when no recycle gas was used. The comparative data are shown in Table 2 and FIG. 7:

As evident from FIG. 7 the molecular weight of the solvent in the first reactor is remarkably increased as compared with when no withdrawal of light oil is carried out. Accordingly the rate of oil collection (light oil and medium oil) is also remarkably increased, that is, 36.3% against 21.1% under the method utilizing no reycle gas. In addition to the conditions mentioned above if 50% by weight of the heavy oil in the slurried mixture is recycled, the rate of oil collection will amount to 46%, which means a rise of 25% compared with the prior art method.

TABLE 2

| Yields for original coal (no water/ no ash basis) | The gas blown (26 m$^3$/t) Examples | No gas blown (none) Prior Art | Remarks |
|---|---|---|---|
| $\Delta H_2$ | −4.8 | −3.4 | |
| CO, $CO_2$ | 9.7 | 11.1 | |
| $H_2O$ | 11.1 | 8.7 | |
| $C_1$~$C_4$ | 4.6 | 3.9 | |
| Collected oils | 36.3 | 21.1 | |
| SRC | 43.1 | 58.6 | 420° C. or more B.P. |

TABLE 2-continued

| Yields for original coal (no water/ no ash basis) | The gas blown (26 $m^3/t$) Examples | No gas blown (none) Prior Art | Remarks |
|---|---|---|---|
| Total | 100 | 100 | |

Advantages of the present invention are listed as follows:

(1) Since the light oils present in the slurrying solvent, and resulting from the hydro-cracking of coal rapidly rise up the reactor together with gases, the slurrying solvent remaining in the reactor is enriched in the heavier fractions, thereby converting into a high-molecular-weight solvent. As a result no severe conditions are required for effecting a hydro-cracking. The light oil content is separated from the gaseous content by a separator after it rises up the reactor, and extracted out of the reactor. The light oil content is no longer subjected to hydro-cracking, thereby eliminating the risk of degenerating it into a low-molecular-weight oil. This is conducive to increasing the rate of oil (light and medium oils) collection.

(2) As described above in (1), the slurrying solvent is fully enriched in the heavier fractions in the reactors, so that a considerable amount of light solvent can be safely added in the preparation of slurry without decreasing the efficiency of hydro-cracking. This facilitates the preparation of slurry and the transport of it along pipe lines.

(3) As a result of the foregoing advantages even if a considerable amount of heavy oil containing asphalten and preasphalten) is recycled, no choking trouble occurs, and owing to the recycling of it the rate of collection of light and medium oils is increased.

(4) Since the recycle gas contains a sufficient amount of hydrogen, it is not necessary to supply too much hydrogen.

What is claimed is:

1. A process for hydroliquefying coal and increasing the production of light oil therefrom, consisting essentially of the steps of:

a) preheating a slurried mixture of pulverized coal and an oil solvent comprised of hydrocarbons having a boiling point of at least 180° C. to which a hydrogenation catalyst has been added, b) adding hydrogen-containing gas to said slurried mixture, c) supplying said hydrogen-containing slurried mixture to a series of hydroliquefaction reactors and liquefying said mixture in said reactors, d) removing from said reactors the gaseous fraction from each reactor and separating from said gaseous fraction the light oil and water content, leaving high hydrogen content gases, e) recycling said high hydrogen content gases directly to the bottom of at least the first of said reactors, thereby (1) promoting stripping of the light oil content from said slurried mixture in said reactor, and (2) maintaining a balance between light and heavy components in said slurried mixture in said reactor during said hydroliquefying step, such that the ratio, by weight, of the light component of said mixture having a boiling point between 300°–420° C. to the heavy component of said mixture comprising coal and residues having a boiling point above 420° C., is from 0.20–1.20, and f) controlling the temperature in said reactor by controlling the temperature of said recycled gas.

2. The process of claim 1, further comprising recovering a heavy oil content fraction from said reactors and recycling at least a portion of said heavy oil content fraction to said slurry prior to preheating.

3. The process of claim 1, wherein said ratio is further maintained by at least one of (a) addition of light oil solvent to said mixture and (b) withdrawal of light oil solvent from said mixture.

4. The process of claim 1, wherein said series of reactors comprises a first and second set of a plurality of reactors, wherein after passage through the last of said first reactor set, said slurried mixture is sent to a separator, wherein said mixture is fractionated and the heavy oil content fraction is isolated, said heavy oil content fraction is mixed with additional oil solvent, and is passed through said second set of reactors with catalyst.

5. The process of claim 4, wherein the light oil content fraction and water content is drawn off from said mixture at each reactor.

6. The process of claim 1, wherein said ratio is 0.30–0.80.

7. The process of claim 1, wherein said high hydrogen content gases are heated during said recycling step e).

* * * * *

UNITED STATES PATENT AND TRADEMARK OFFICE

CERTIFICATE OF CORRECTION

PATENT NO. : 5,269,910

DATED : December 14, 1993

INVENTOR(S) : Tetsuo Matsumura et al.

It is certified that error appears in the above-indentified patent and that said Letters Patent is hereby corrected as shown below:

On the title page, Item [54] and Column 1, Line 2,

The title should read: --METHOD OF COAL LIQUEFACTION BY HYDROGENATION--

Signed and Sealed this

Twenty-first Day of June, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,269,910

DATED : December 14, 1993

INVENTOR(S) : Tetsuo MATSUMURA et al

It is certified that error appears in the above-identified patent and that said Letters Patent is hereby corrected as shown below:

Drawings:

Please delete FIGs. 3A, 3B, 4A and 4B and substitute therefor the attached FIGs. 3A, 3B, 4A and 4B.

Signed and Sealed this

Third Day of January, 1995

Bruce Lehman

*Attest:*

BRUCE LEHMAN

*Attesting Officer*

*Commissioner of Patents and Trademarks*